US012723415B2

(12) United States Patent
Ramalho et al.

(10) Patent No.: US 12,723,415 B2
(45) Date of Patent: Sep. 1, 2026

(54) WORK PLATFORM AND METHOD

(71) Applicant: Werner Co., Itasca, IL (US)

(72) Inventors: Carla Ramalho, Sycamore, IL (US); Devin Hughes, Itasca, IL (US); Slavisa Dacic, Hanover Park, IL (US); John Maher, Crystal Lake, IL (US); Dave Pozgay, Wilmette, IL (US); Michael Melton, Glen Ellyn, IL (US)

(73) Assignee: Werner Co., Itasca, IL (US)

( * ) Notice: Subject to any disclaimer, the term of this patent is extended or adjusted under 35 U.S.C. 154(b) by 877 days.

(21) Appl. No.: 17/863,220

(22) Filed: Jul. 12, 2022

(65) Prior Publication Data

US 2023/0014482 A1 Jan. 19, 2023

Related U.S. Application Data

(60) Provisional application No. 63/221,321, filed on Jul. 13, 2021.

(51) Int. Cl.
*E04G 1/30* (2006.01)

(52) U.S. Cl.
CPC ..... *E04G 1/30* (2013.01); *E04G 2001/305* (2013.01); *E04G 2001/307* (2013.01)

(58) Field of Classification Search
CPC ..... E04G 2001/305; E04G 2001/307; E04G 2001/157; E04G 2001/302
See application file for complete search history.

(56) References Cited

U.S. PATENT DOCUMENTS

| | | | |
|---|---|---|---|
| 111,660 | A | 2/1871 | Martz |
| 581,727 | A | 5/1897 | Inglish |
| 967,898 | A | 8/1910 | Gilmore |
| 1,133,109 | A | 3/1915 | Derbyshire |
| 1,474,250 | A | 11/1923 | Folliard |
| 2,206,314 | A | 7/1940 | Werner |
| 2,587,177 | A | 2/1952 | Larson |

(Continued)

FOREIGN PATENT DOCUMENTS

| | | |
|---|---|---|
| CN | 1046773 | 11/1990 |
| CN | 2908669 | 6/2007 |

(Continued)

OTHER PUBLICATIONS

Gorilla Ladder Model #GLP-WP, Brochure, May 2016.

(Continued)

*Primary Examiner* — Jonathan Liu
(74) *Attorney, Agent, or Firm* — Fitch, Even, Tabin & Flannery LLP

(57) ABSTRACT

A work platform includes a plank which telescopes to a desired width. The work platform includes a first leg assembly rotatably attached adjacent to a first end of the plank. The work platform includes a second leg assembly rotatably attached adjacent to a second end of the plank. The plank is in an open position when the plank is supported by the first leg assembly and second leg assembly and the first leg assembly and second leg assembly form an angle greater than 25 degrees with the plank. The plank is in a closed position when the first leg assembly and second leg assembly are adjacent to and in parallel with the plank. A method for using a work platform. A method for producing a work platform.

10 Claims, 13 Drawing Sheets

(56) References Cited

U.S. PATENT DOCUMENTS

| | | | |
|---|---|---|---|
| 2,587,377 | A | 2/1952 | Penrose |
| 2,723,073 | A | 11/1955 | Fellowes |
| 2,771,235 | A | 11/1956 | Stephenson |
| 2,793,386 | A | 5/1957 | Muhlhauser |
| 2,832,648 | A | 4/1958 | Goosmann |
| 3,128,842 | A | 4/1964 | Satrum |
| 3,250,344 | A | 5/1966 | Romano |
| 3,372,441 | A | 3/1968 | Fisher |
| 3,848,700 | A | 11/1974 | Davis |
| 3,997,024 | A | 12/1976 | Fredricks |
| 4,191,111 | A | 3/1980 | Emmert |
| 4,383,488 | A | 5/1983 | Macho |
| 4,524,902 | A | 6/1985 | Mortimer |
| 4,690,248 | A | 9/1987 | Killeen |
| 4,971,201 | A | 11/1990 | Sathre |
| 5,067,589 | A | 11/1991 | Bartnicki |
| 5,074,009 | A | 12/1991 | Simonton |
| 5,074,461 | A | 12/1991 | Parker |
| 5,096,019 | A | 3/1992 | Kelsay |
| 5,246,085 | A | 9/1993 | Liegel |
| 5,282,519 | A | 2/1994 | Venturo |
| 5,332,062 | A | 7/1994 | Revere |
| 5,462,221 | A | 10/1995 | Zink |
| 5,678,653 | A | 10/1997 | Clinch |
| 5,746,288 | A | 5/1998 | O'Neal |
| 5,950,972 | A | 9/1999 | Irish |
| 5,984,047 | A | 11/1999 | Rogers |
| 6,017,106 | A | 1/2000 | Adams |
| 6,189,653 | B1 | 2/2001 | Laug |
| 6,223,390 | B1 | 5/2001 | Lotufo |
| 6,425,520 | B1 | 7/2002 | Peterson |
| D461,330 | S | 8/2002 | Wang |
| 6,427,804 | B1 | 8/2002 | Lazarus |
| 6,619,540 | B1 | 9/2003 | Bazany |
| 6,681,895 | B2 | 1/2004 | Virtue |
| D486,243 | S | 2/2004 | Yamaoka |
| D486,244 | S | 2/2004 | Yamaoka |
| D490,165 | S | 5/2004 | Yamaoka |
| D495,426 | S | 8/2004 | Yamaoka |
| 6,808,105 | B2 | 10/2004 | Lee |
| 6,892,860 | B2 | 5/2005 | Gibson |
| D536,799 | S | 2/2007 | Freitas |
| 7,210,560 | B2 | 5/2007 | Brink |
| 7,516,704 | B2 | 4/2009 | Snider |
| 7,549,381 | B1 | 6/2009 | Nail, Jr. |
| 7,571,960 | B2 | 8/2009 | Williams |
| 7,686,134 | B1 | 3/2010 | Harris |
| 7,690,316 | B2 | 4/2010 | Yoo |
| 8,042,653 | B2 | 10/2011 | Grebinoski |
| 8,113,316 | B2 | 2/2012 | Sward |
| 8,307,515 | B2 | 11/2012 | Ramsauer |
| 8,307,769 | B1 | 11/2012 | Wescott |
| 8,381,873 | B2 | 2/2013 | Cross |
| D704,858 | S | 5/2014 | Green |
| 8,727,074 | B1 | 5/2014 | Bhajan |
| 8,777,683 | B2 | 7/2014 | Friedman |
| 9,120,218 | B1 | 9/2015 | Stehlik |
| 9,512,627 | B2 | 12/2016 | Taron |
| D776,826 | S | 1/2017 | Foley |
| D781,083 | S | 3/2017 | Zhu |
| 9,752,334 | B2 | 9/2017 | Foley |
| 10,343,274 | B2 | 7/2019 | Katz |
| 10,450,799 | B2 | 10/2019 | Lawler |
| 10,738,487 | B2 | 8/2020 | Woodward |
| D895,844 | S | 9/2020 | Woodward |
| 10,815,680 | B2 | 10/2020 | Woodward |
| 10,858,848 | B2 | 12/2020 | Woodward |
| 11,577,883 | B2 | 2/2023 | Ripplinger |
| 2002/0162841 | A1 | 11/2002 | Shamir |
| 2002/0178978 | A1 | 12/2002 | Wang |
| 2003/0000770 | A1 | 1/2003 | Virtue |
| 2003/0100421 | A1 | 5/2003 | Lee |
| 2004/0238278 | A1 | 12/2004 | Gibson |
| 2004/0238280 | A1 | 12/2004 | Gibson |
| 2006/0130715 | A1 | 6/2006 | Yoo |
| 2006/0169539 | A1* | 8/2006 | Grebinoski ..... E04G 1/15 182/223 |
| 2007/0101910 | A1 | 5/2007 | Haimoff |
| 2007/0261916 | A1 | 11/2007 | Sward |
| 2007/0289813 | A1* | 12/2007 | Bothwell ..... E04G 1/152 182/222 |
| 2009/0078165 | A1 | 3/2009 | Tseng |
| 2009/0123736 | A1 | 5/2009 | Green |
| 2009/0133959 | A1 | 5/2009 | Eriksson |
| 2010/0071996 | A1 | 3/2010 | Huang |
| 2010/0269302 | A1 | 10/2010 | Jagannathan |
| 2010/0282540 | A1 | 11/2010 | Moss |
| 2011/0056764 | A1 | 3/2011 | Cross |
| 2012/0061182 | A1 | 3/2012 | Grimes |
| 2013/0140110 | A1 | 6/2013 | Ken-Dror |
| 2014/0290010 | A1 | 10/2014 | Friedman |
| 2015/0267469 | A1 | 9/2015 | Markusen |
| 2017/0044780 | A1 | 2/2017 | Foley |
| 2017/0275899 | A1 | 9/2017 | Woodward |
| 2017/0275900 | A1 | 9/2017 | Woodward |
| 2018/0085912 | A1 | 3/2018 | Cindric |
| 2018/0119434 | A1* | 5/2018 | Mikic ..... E04G 5/08 |
| 2018/0171648 | A1 | 6/2018 | Woodward |
| 2018/0202177 | A1 | 7/2018 | Woodward |
| 2019/0226217 | A1 | 7/2019 | Foley |
| 2019/0387887 | A1 | 12/2019 | Yan |
| 2021/0071433 | A1 | 3/2021 | Woodward |
| 2022/0178153 | A1 | 6/2022 | Woodward |
| 2023/0139449 | A1 | 5/2023 | David |
| 2024/0368902 | A1 | 11/2024 | Woodward |

FOREIGN PATENT DOCUMENTS

| | | | |
|---|---|---|---|
| CN | 103569460 | | 2/2014 |
| CN | 205046823 | | 2/2016 |
| DE | 202011050814 | U1 | 1/2012 |
| GB | 2207453 | A | 2/1989 |
| GB | 2343883 | | 5/2002 |
| GB | 2499186 | A | 8/2013 |
| JP | 2001224439 | | 8/2001 |
| JP | 2002129744 | | 5/2002 |
| JP | 2004323036 | | 11/2004 |
| JP | 2005232707 | | 9/2005 |
| JP | 2006022530 | | 1/2006 |
| KR | 100714993 | | 5/2007 |

OTHER PUBLICATIONS

Werner Co., "Werner #1 in Ladders, Climbing Equipment," Werner Catalog 2015, p. 41, 42, back page.

Werner Ladder Co, "Werner Ladder—AP-35 Aluminum PRO Linking Work Platform", published Oct. 26, 2017, URL: https://www.youtube.com/watch?v=tVYVyVwuSd4, (Apr. 10, 2018), XP002779894.

* cited by examiner

WORK PLATFORM AND METHOD

CROSS-REFERENCE TO RELATED APPLICATIONS

This is a nonprovisional of U.S. provisional patent application Ser. No. 63/221,321 filed Jul. 13, 2021, incorporated by reference herein.

FIELD

The present invention is related to an extendable work platform which, in a closed position, can be used as a scaffold. (As used herein, references to the "present invention" or "invention" relate to exemplary embodiments and not necessarily to every embodiment encompassed by the appended claims.) More specifically, the present invention is related to an extendable work platform, which in a closed position, can be used as a scaffold having a linkage which engages support structures to securely and stably hold the work platform in the closed position as a scaffold.

BACKGROUND

This section is intended to introduce the reader to various aspects of the art that may be related to various aspects of the present invention. The following discussion is intended to provide information to facilitate a better understanding of the present invention. Accordingly, it should be understood that statements in the following discussion are to be read in this light, and not as admissions of prior art.

A user commonly must adapt to the needs of the work environment. It is typically desirable to have a single product serve more than one function rather than to have multiple separate products having to serve multiple functions. In certain instances, a user requires a work platform and separately, a scaffold. It would be advantageous to have a single apparatus which serves as a work platform and also serves as a scaffold.

BRIEF SUMMARY

The present invention pertains to a work platform. The work platform comprises a plank which telescopes to a desired width. The work platform comprises a first leg assembly rotatably attached adjacent to a first end of the plank. The work platform comprises a second leg assembly rotatably attached adjacent to a second end of the plank. The work platform is in an open position when the plank is supported by the first leg assembly and second leg assembly and the first leg assembly and second leg assembly form an angle greater than 25 degrees with the plank. The work platform is in a closed position when the first leg assembly and second leg assembly are folded adjacent to and in parallel with the plank.

The present invention pertains to a method for using a work platform. The method comprises the steps of extending a plank which extends and retracts the work platform to a desired width determined by a distance between a first support structure and a second support structure separate and apart from the first support structure. There is the step of moving a first leg assembly of the work platform which is rotatably attached adjacent to a first end of the plank and a second leg assembly of the work platform which is rotatably attached adjacent to a second end of the plank from an open position, where the plank is supported by the first leg assembly and second leg assembly on ground and the first leg assembly and second leg assembly each form an angle greater than 25 degrees with the plank, to a closed position, where the first leg assembly and second leg assembly are adjacent to and in parallel with the plank. There is the step of placing the first end of the plank on the first support structure and the second end of the plank on the second support structure when the plank and the first leg assembly and second leg assembly are in a closed position.

The present invention pertains to a method for producing a work platform. The method comprises the steps of placing first supports of a first portion into hollow deck supports of a deck, the first supports able to move in and out of the deck supports. There is the step of placing a hook into one first supports of the first supports, the hook able to move in and out of the one first support.

DETAILED DESCRIPTION

Figure 1:
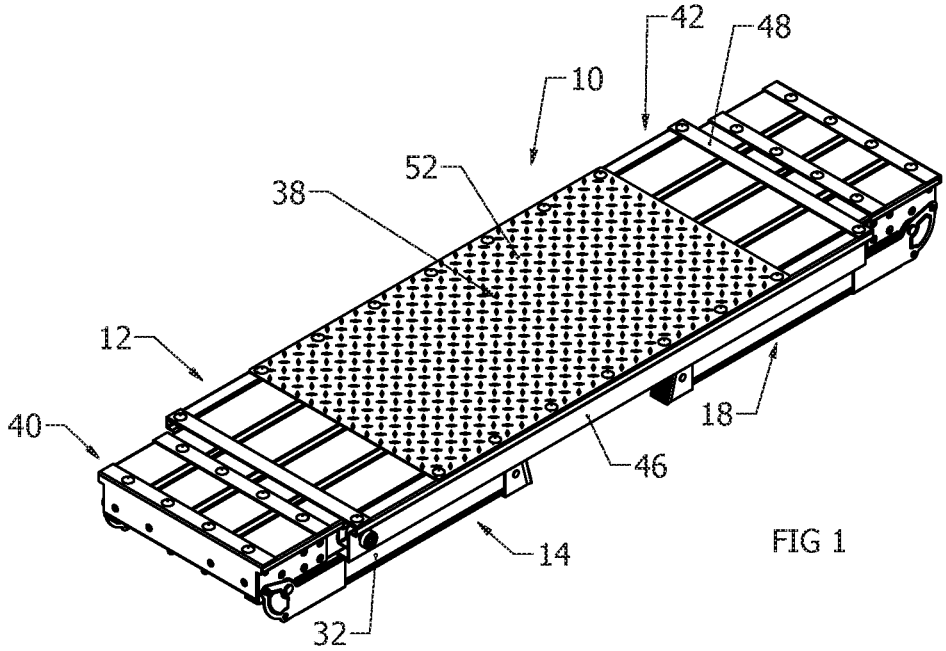
FIG. 1 shows the work platform with the legs folded and the deck in the shortest retracted condition.
Figure 2:
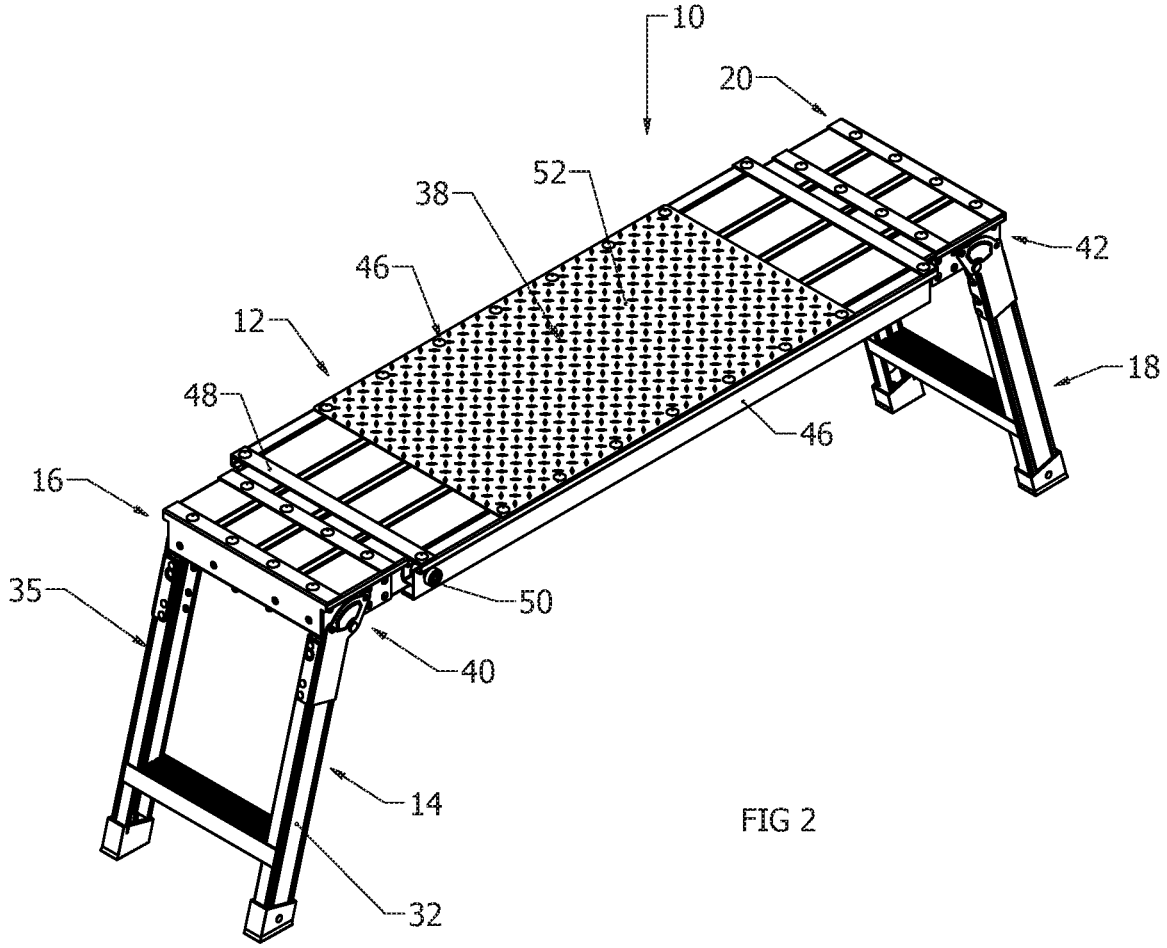
FIG. 2 shows the work platform with the legs extended.
Figure 3:
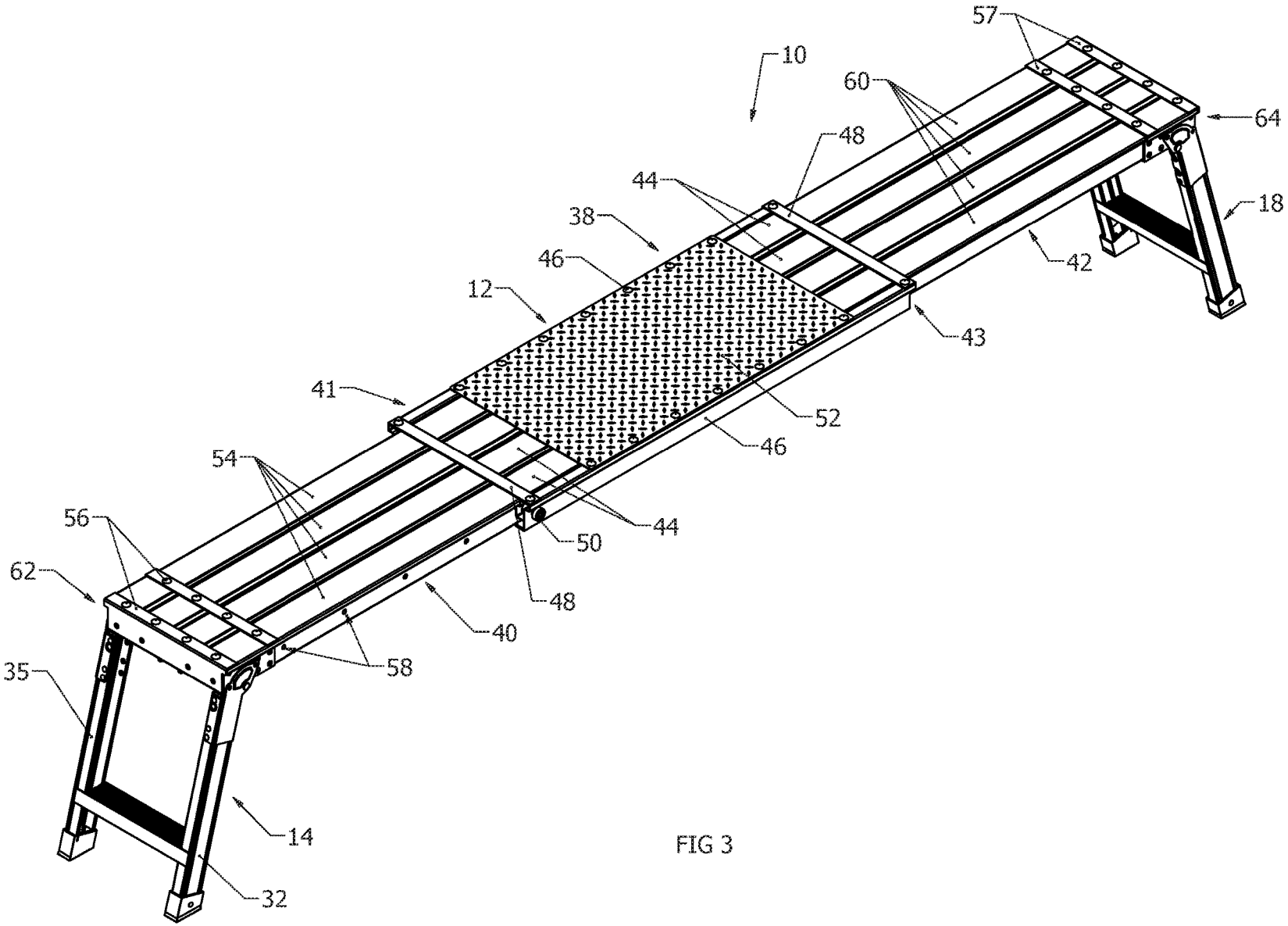
FIG. 3 shows the work platform in the work platform mode and the deck extended to its maximum length.
Figure 4:
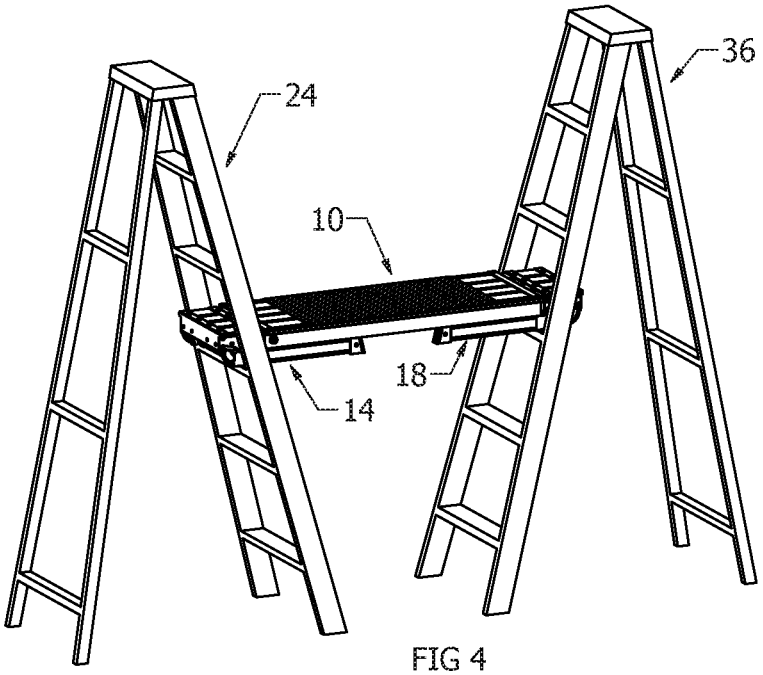
FIG. 4 shows the work platform when used as a plank in its retracted condition.
Figure 5:
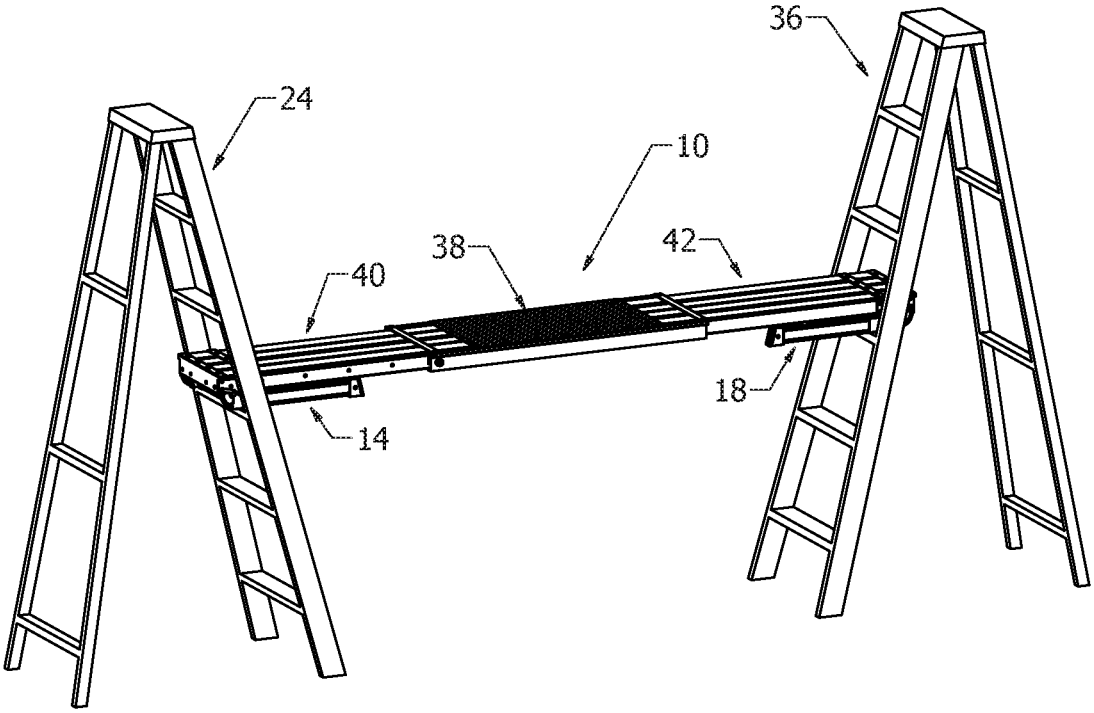
FIG. 5 shows the work platform when used as a plank in its extended condition.

Referring now to the drawings wherein like reference numerals refer to similar or identical parts throughout the several views, and more specifically to FIGS. 1-5 there is shown a work platform 10. The work platform 10 comprises a plank 12 which extends and retracts to a desired width. The work platform 10 comprises a first leg assembly 14 rotatably attached adjacent to a first end 16 of the plank 12. The work platform 10 comprises a second leg assembly 18 rotatably attached adjacent to a second end 20 of the plank 12. The work platform 10 is in an open position when the plank 12 is supported by the first leg assembly 14 and second leg assembly 18 and the first leg assembly 14 and second leg assembly 18 form an angle greater than 25 degrees with the plank 12, as shown in FIGS. 2 and 3. The work platform 10 is in a closed position when the first leg assembly 14 and second leg assembly 18 are adjacent to and in parallel with the plank 12, as shown in FIGS. 1, 4 and 5.

Figure 6:
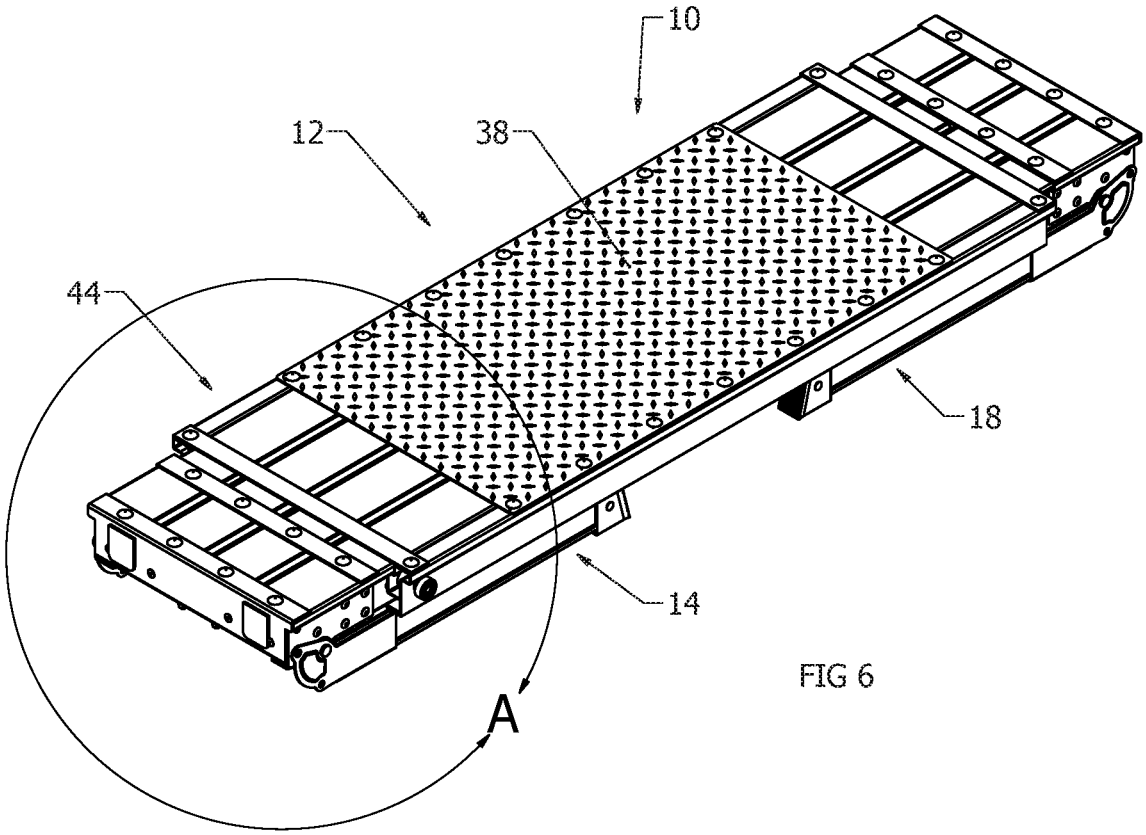
FIG. 6 shows an additional feature of this invention. Hooks are mounted in the work platform at both ends which can be moved to a stowed position.
Figure 6A:
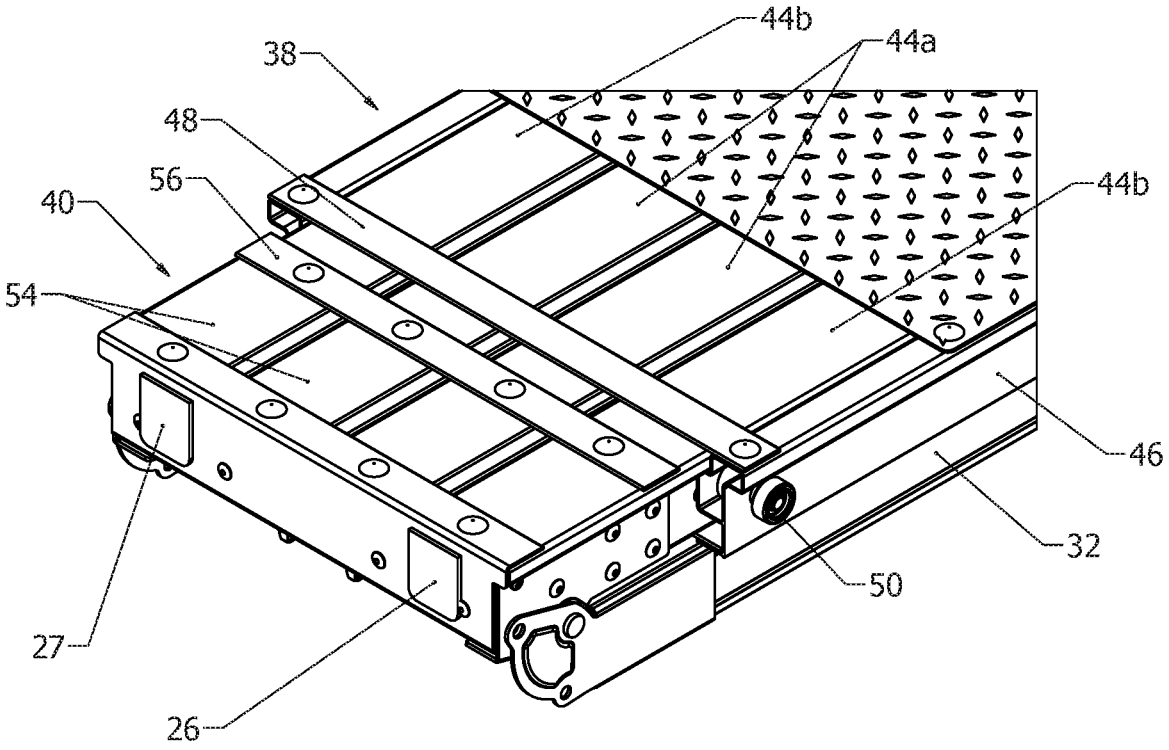
FIG. 6A is a sectional view of A of FIG. 6.
Figure 7:
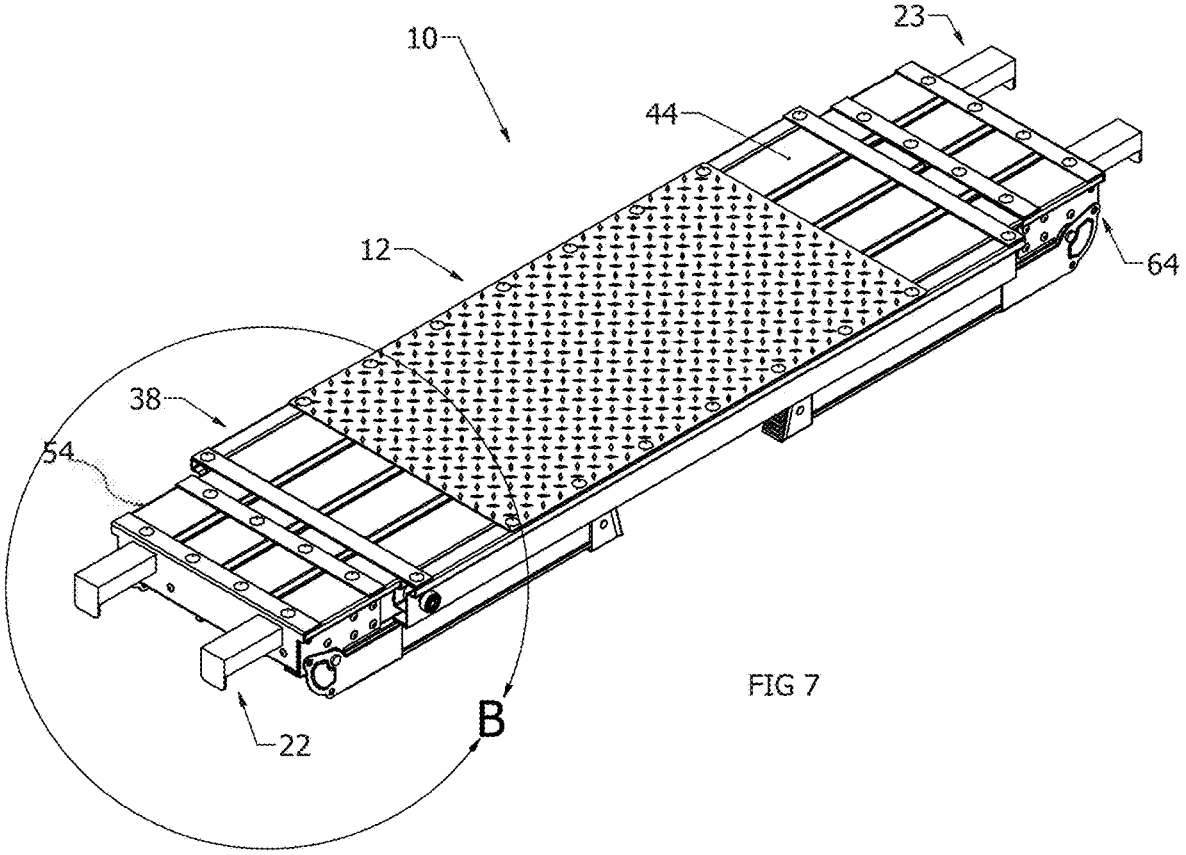
FIG. 7 shows the hooks mounted in the work platform at both ends which can are moved to a deployed position.

The work platform 10 may include a first linkage 22 which extends from the first end 16 of the plank 12 adapted to engage a first support structure 24 to securely and stably hold the plank 12 to the first support structure 24, as shown in FIGS. 6, 6A, 7 and 7 A, 8 and 9. The first linkage 22 may be a first hook 26 which extends from the first end 16 of the plank 12. The first hook 26 may be part of a handle 28 which extends from the first end 16 of the plank 12, as shown in FIGS. 10, 10A, 11, 11A and 12. The work platform 10 may include a spring 30 which biases the handle 28 to a closed position with the plank 12 when the first hook 26 is apart from the first support structure 24. Alternatively, first leg assembly 14 may include a first leg 32 having a first recess 34 which is adapted to fit onto an engage the first support structure 24, as shown in FIGS. 13, 13A, 14, 14A, and 15.

The first leg assembly 14 may include a second leg 35 in parallel with and in spaced relation with the first leg 32, as shown in FIGS. 2 and 3. There may be a step 70 extending between and attached to the first leg 32 and the second leg 35. The second leg assembly 18 may include a first leg 32 and a second leg 35 in parallel with and in spaced relation with the first leg 32 of the second leg assembly 18, and may have a step extending between and attached to the first leg 32 and the second leg 35 of the second leg assembly 18.

The present invention pertains to a method for using a work platform 10. The method comprises the steps of extending a plank 12 which extends and retracts the work platform 10 to a desired width determined by a distance between a first support structure 24 and a second support structure 36 separate and apart from the first support structure 24. There is the step of moving a first leg assembly 14 of the work platform 10 which is rotatably attached adjacent to a first end 16 of the plank 12 and a second leg assembly 18 of the work platform 10 which is rotatably attached adjacent to a second end 20 of the plank 12 from an open position, where the plank 12 is supported by the first leg assembly 14 and second leg assembly 18 on ground and the first leg assembly 14 and second leg assembly 18 each form an angle greater than 25 degrees with the plank 12, to a closed position, where the first leg assembly 14 and second leg assembly 18 are adjacent to and in parallel with the plank 12. There is the step of placing the first end 16 of the plank 12 on the first support structure 24 and the second end 20 of the plank 12 on the second support structure 36 when the plank 12 and the first leg assembly 14 and second leg assembly 18 are in a closed position.

The placing step may include the steps of engaging a first linkage 22 from adjacent the first end 16 of the plank 12 with the first support structure 24, and engaging a second linkage 23 from adjacent the second end 20 of the plank 12 with the second support structure 36 so the plank 12 is securely and stably held to the first and second support structures 24, 36. The engaging the first linkage 22 step may include the step of moving a first hook 26 outwards from the first end 16 of the plank 12. The engaging the second linkage 23 step may include the step of moving a second hook 27 outwards from the first end 16 of the plank 12. Alternatively, the placing step may include the step of engaging a first recess 34 of a first leg of the first leg assembly 14 and a second recess 33 of a second leg of the first leg assembly 14 with the first support structure 24 so the plank 12 is securely and stably held with the first and second support structures. The first support structure 24 may be a rung of a ladder.

The present disclosure pertains to a method for producing a work platform 10. The method comprises the steps of placing a plurality of first supports 54 of a first portion 40 into hollow deck supports 44 of a deck, the plurality of first supports 54 able to move in and out of the deck supports 44. There is the step of placing a hook 26, 27 into one of the first supports 54 of the plurality of first supports 54, the hook 26, 27 able to move in and out of the one of the first supports 54.

Also disclosed is an extendable work platform 10 with folding legs which can also be used as a telescoping plank 12 between supporting structures 24, 36 when the legs are folded, as shown in FIGS. 1-5. The width of the plank 12 enables it to be placed between the rails of conventional ladders. Thus, the work platform 10 is a combination of an extendable plank 12 with leg assemblies which can be used as a work platform 10, or as a scaffold placed between two support structures 24, 36, such as to ladders on their steps 65, with the leg assemblies folded up, which may be referred to as a "plankform". The work platform 10 supports at least 250 pounds of load in the open extended position, and even more than 500 pounds of load without failing when it is in the open extended position or being used as a scaffold in the extended position and supported on either side, as described herein, preferably by a step 65 of the first support structure 24 and a step 65 of the second support structure 36.

In one embodiment, retractable hooks 26, 27 extend from the end of the plank 12 and fit over the rungs, steps, etc., which the plank 12 will rest on, as shown in FIGS. 6-9.

Figure 10A:
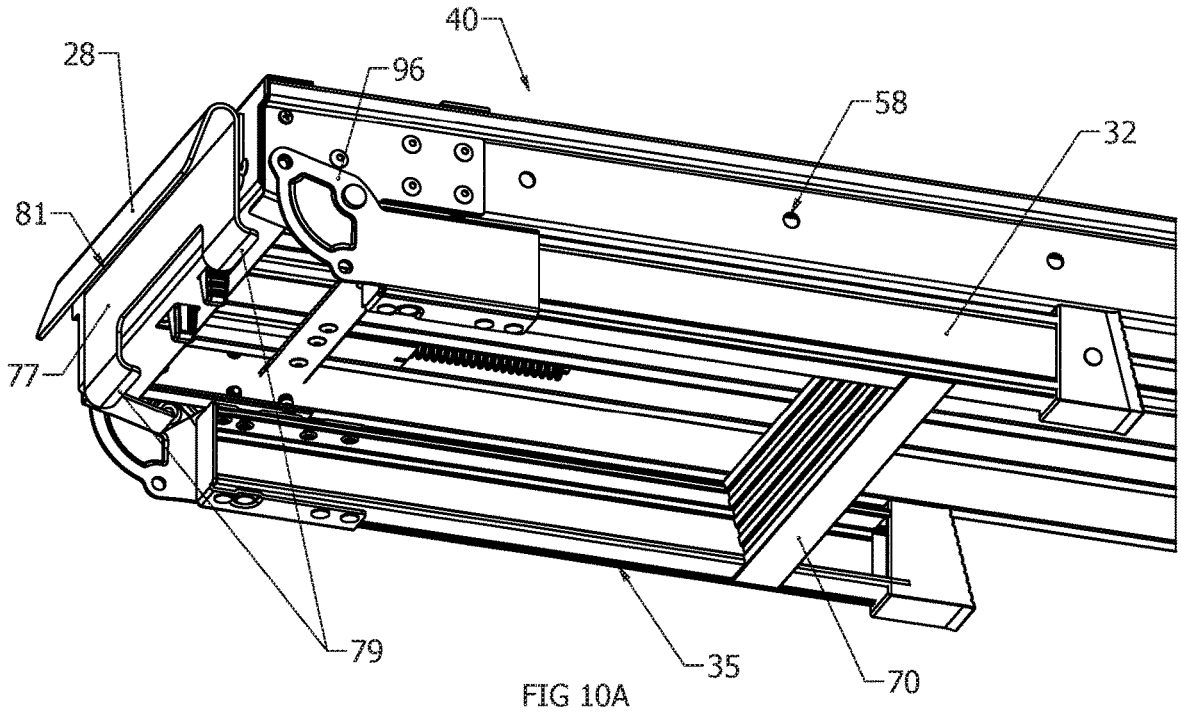
FIG. 10A is a bottom perspective view of the first portion with the handle and hooks in a retracted position.
Figure 10:
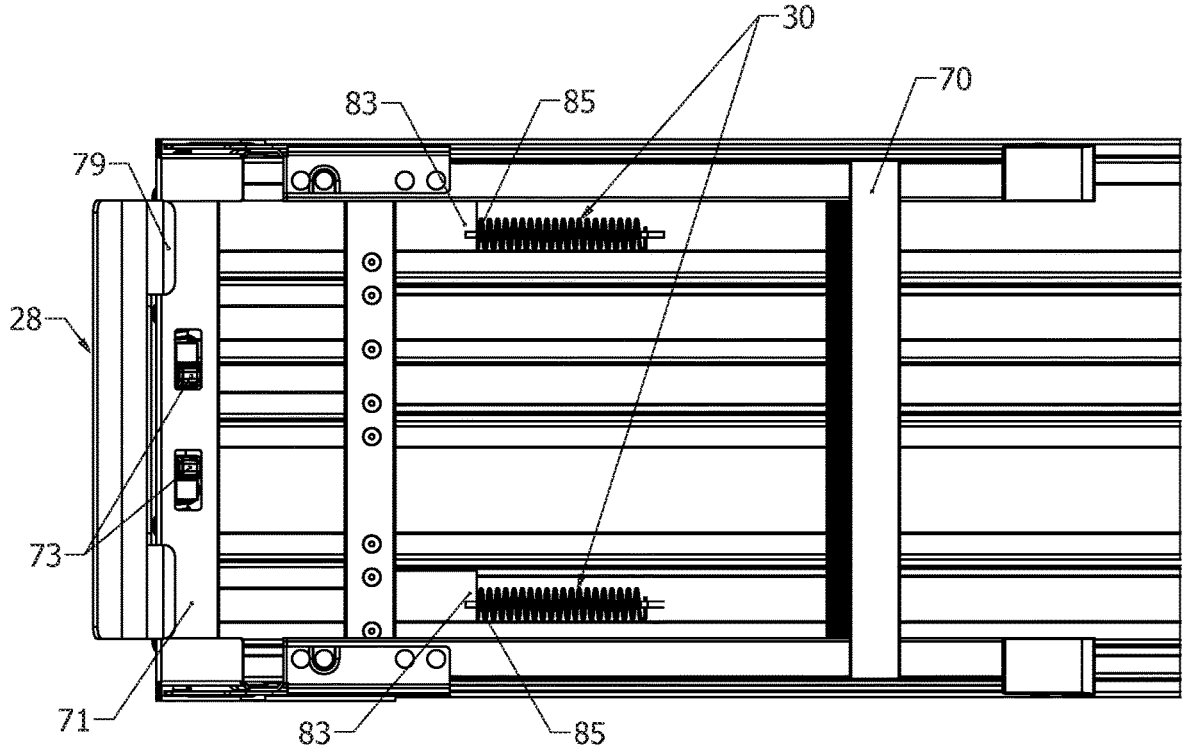
FIG. 10 shows a further embodiment of a work platform in which springs tend to cause the hooks to retract and a handle extends between the hooks.
Figure 11A:
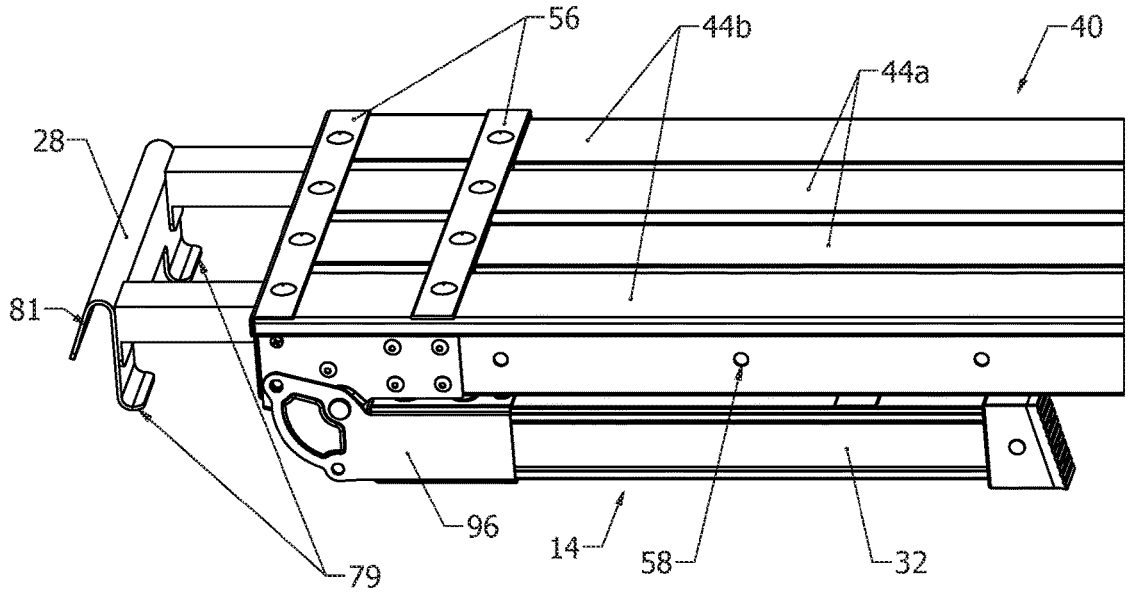
FIG. 11A is an overhead perspective view of the first portion with the handle and hooks in an extended position.
Figure 11:
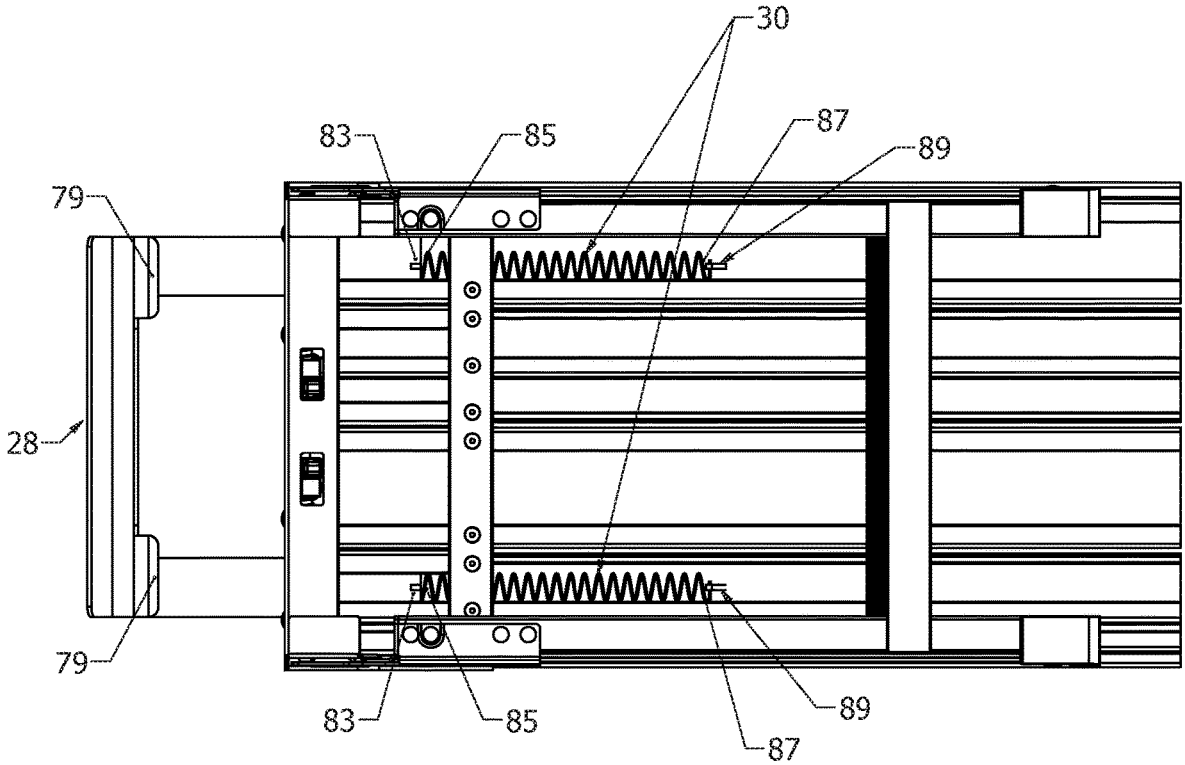
FIG. 11 is a bottom view of the embodiment of FIG. 10.
Figure 12:
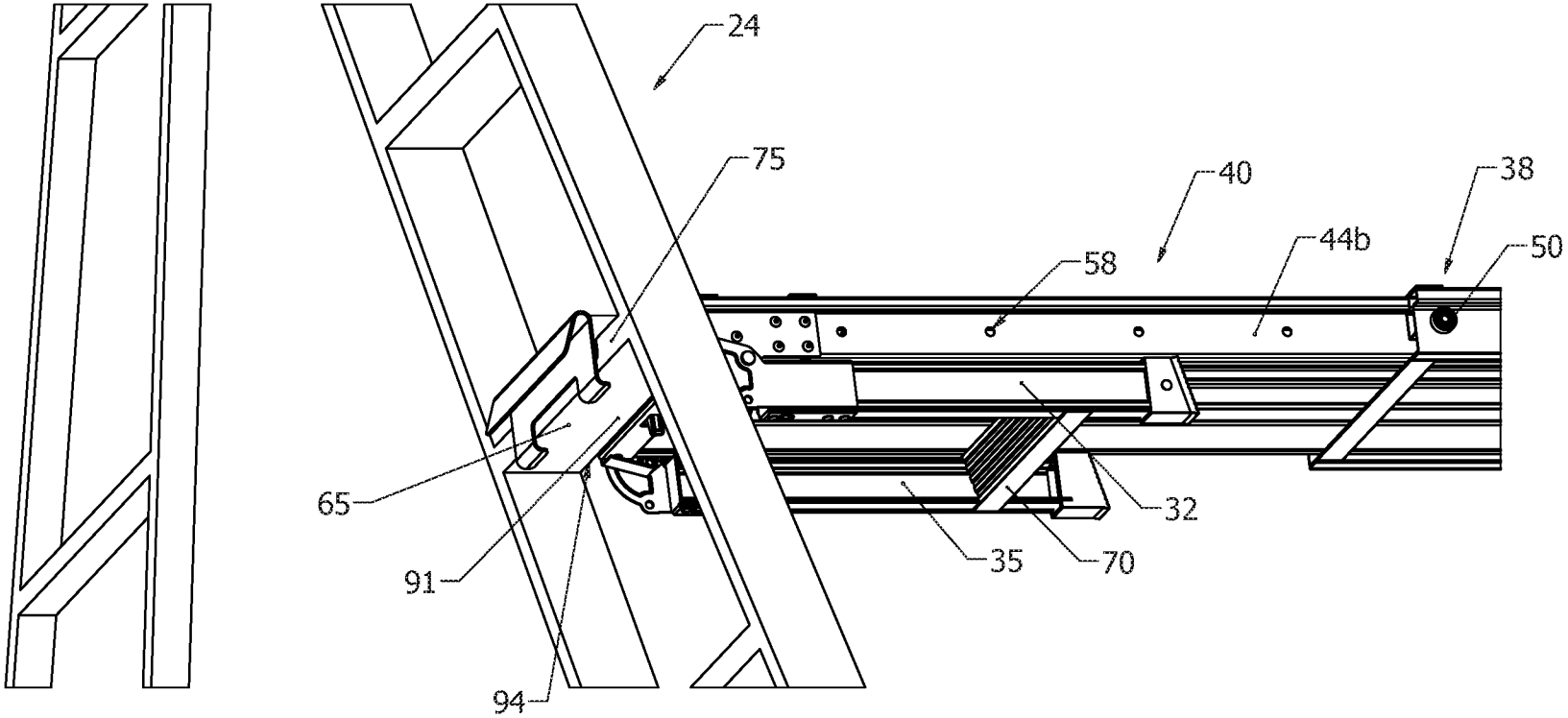
FIG. 12 shows the work platform of FIG. 10 laid onto its supports.

In another embodiment, the hooks 26, 27 are spring-loaded which draw the plank 12 into snug engagement with its supports 54, 60, as shown in FIG. 10-12, with or without a handle 28.

Figure 13:
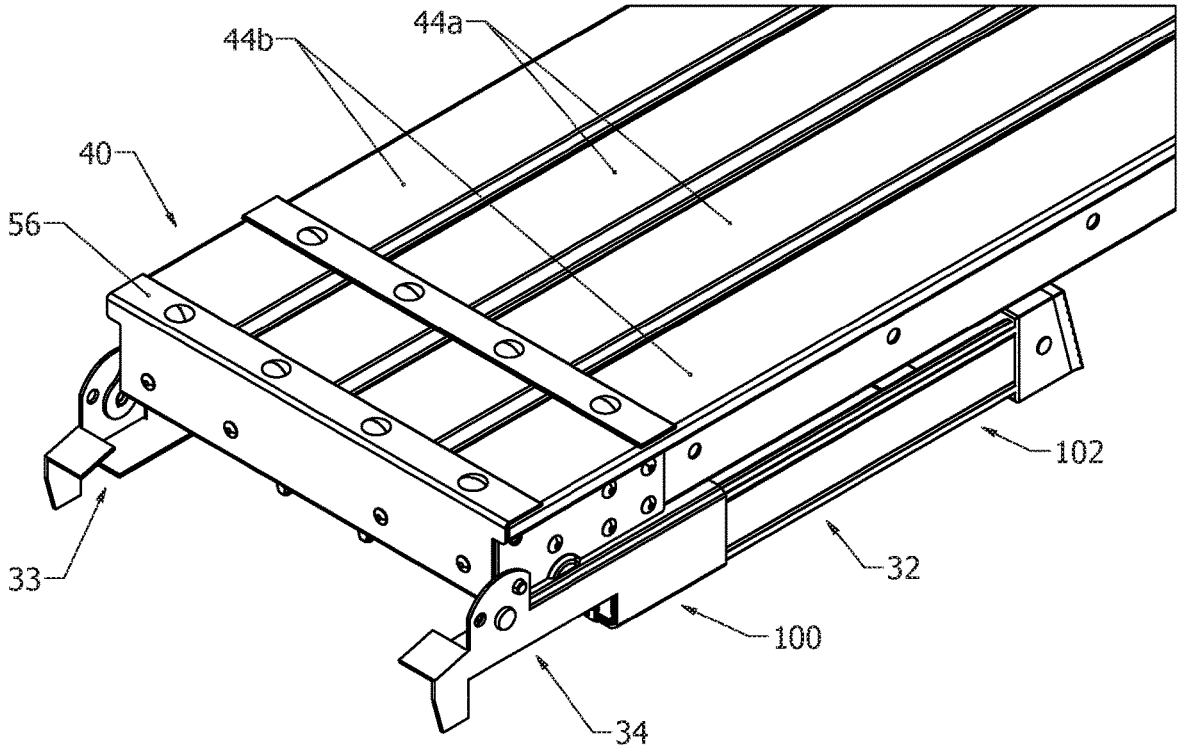
FIG. 13 shows how recesses are formed in the legs which are positioned to engage the work platform support surfaces when the legs are in the folded position.
Figure 14:
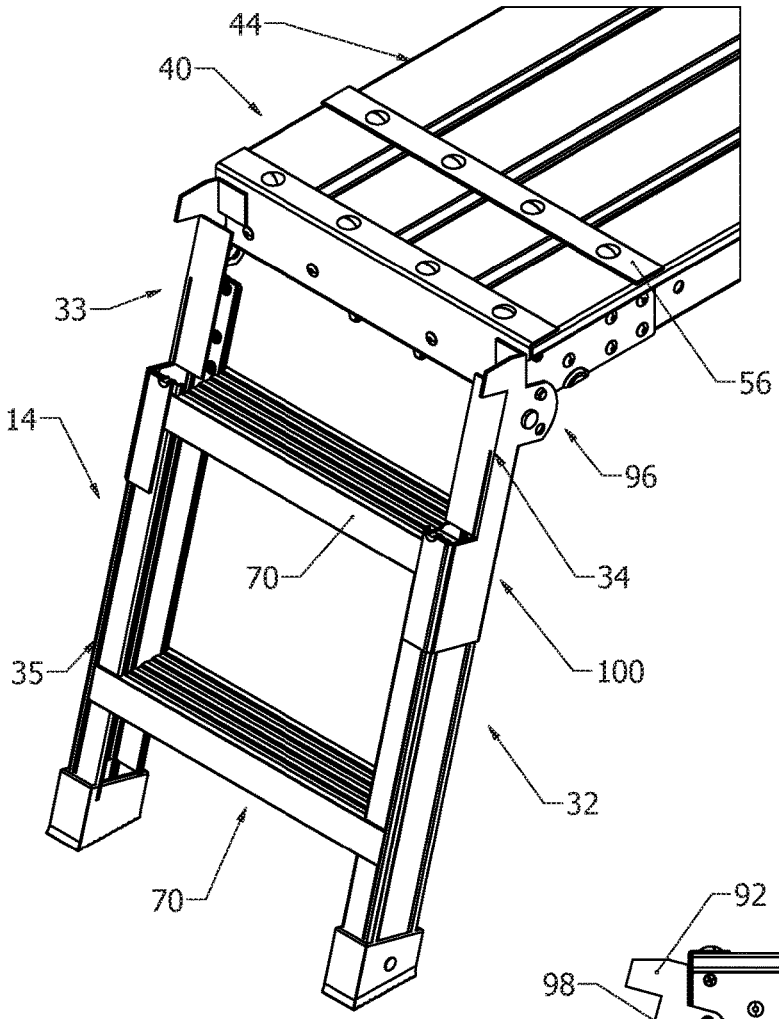
FIG. 14 shows how recesses are formed in the legs which are positioned to engage the work platform support surfaces when the legs are in the open position.
Figure 15:
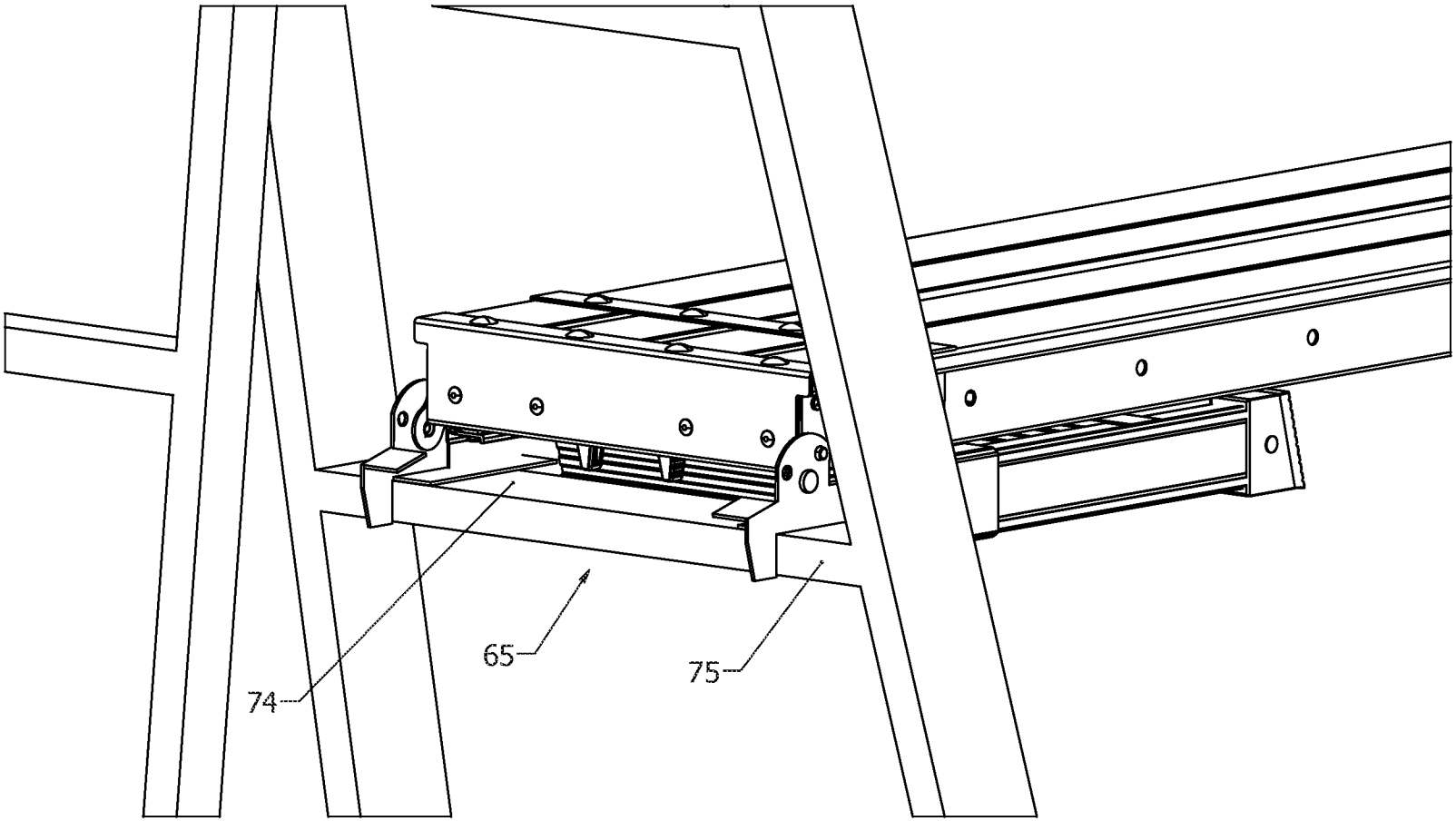
FIG. 15 shows the work platform supported by a ladder with the recesses engaged with the ladder steps.

In another embodiment, recesses 33, 34 are formed in the work platform 10 legs 32, 35 which are used to engage the support, as shown in FIGS. 13-15.

The work platform 10 enables the user to adapt to the needs of the work environment without needing two separate products. The length of the work platform 10 in either mode of use is adjustable between 4' and 8' which enables the user to work in a large area without having to relocate the work platform 10.

Additionally, the embodiment with extendable hooks 26, 27 permits 100% of the plank 12 standing area to be used, and the hooks 26, 27 provide very solid engagement with the plank 12 support surface.

FIG. 1 shows the work platform 10 in the closed position with the leg assemblies 14, 18 folded and the plank 12 in the shortest retracted position. In this state, the work platform 10 can be easily transported or stored. The plank 12 is preferably comprised of a deck 38, a first portion 40 which extends and retracts from a first side 41 of the deck 38, and a second portion 42 which extends and retracts from a second side 43 of the deck 38, as shown in FIG. 3. The deck 38 itself is comprised of a plurality of hollow deck supports 44 of the same dimensions, having either a rectangular or C shaped cross-section, which are in parallel and adjacent with each other and fixed together. Here, there are four deck supports 44 attached together, with two interior deck supports 44*a* and two exterior deck supports 44*b*. On either side of the outside of both exterior deck supports 44*b* is a side bracket 46 which extends the length of the exterior deck support it is alongside. Extending perpendicular from and attached adjacent each end of the side brackets 46 is a top deck bracket 48. The top deck bracket 48 fits over the deck supports 44 and does not block any portion of the hollow interior of the deck supports 44. Adjacent one end of each side bracket 46 is fixed a lock 50 to lock the first portion 40 and the second portion 42 at a desired position relative to the deck 38. An example of a type of lock that can be used as described in U.S. Pat. No. 5,067,589, incorporated by reference herein. A flat serrated metal plate 52 may be positioned atop the deck supports 44 and attached to both side brackets 46.

The first portion 40 is comprised of four first supports 54 which are attached together like the deck supports 44, although each of the first supports 54 has a cross-section which is smaller than the cross-section of the deck supports 44 so the first supports 54 can fit into and slide in and out of the deck supports 44. One first support 54 fits into one deck support 44. The first supports 54 are aligned and fitted into the deck supports 44 at the first side 41 of the deck 38. There may be one or more top first brackets 56 fitting over the first supports 54 and attached to the first supports 54 between the two external first supports 54 to fix the first supports 54 together.

There are locking holes 58 present at regular intervals on the outside of the external first support 54 which is adjacent the lock 50 on the side bracket 46. The lock 50 fits into the desired locking hole to lock the first portion 40 at a desired position relative to the deck 38. The second portion 42 is comprised of four second supports 60 and are configured and operate in the same way as the first portion 40 and with respect to the deck 38. There may be one or more top second brackets 57 fitting over the second supports 60 and attached to the second supports 60 between the two external second supports 60 to fix the second supports 60 together.

The first leg assembly 14 is rotatably attached adjacent to the outer end 62 of the first portion 40 and the second leg assembly 18 is rotatably attached adjacent to the outer end 64 of the second portion 42. The length of the first supports 54 and the length of the second supports 60 are generally slightly less than half the length of the deck supports 44 so when the first and second supports 54, 60 are moved into the retracted position, the first and second supports 54, 60 do not block each other from fitting all the way into the deck supports 44. The top first bracket also may act as a stop when it abuts the top deck bracket 48 at the first side 41 of the deck 38 when the first portion 40 is moved into the deck 38. In the same way the top second bracket 57 may also act as a stop when it abuts the top deck bracket 48 at the second side 43 of the deck 38 when the second portion 42 is moved into the deck 38.

FIG. 2 shows the work platform 10 with the leg assemblies 14, 18 opened and the plank 12 in a retracted position. In this mode, the work platform 10 can be used as a conventional work platform 10.

FIG. 3 shows the work platform 10 with the leg assemblies 14, 18 opened and the plank 12 in an extended position where it is extended to its maximum length.

FIGS. 4 and 5 show the work platform 10 with the leg assemblies 14, 18 closed and used as a scaffold with the plank 12 in its retracted and extended conditions, respectively. It is shown resting on the steps 65 of stepladders but could also be used with roof jacks, scaffolds, etc., in the manner which conventional planks are used.

Figure 7A:
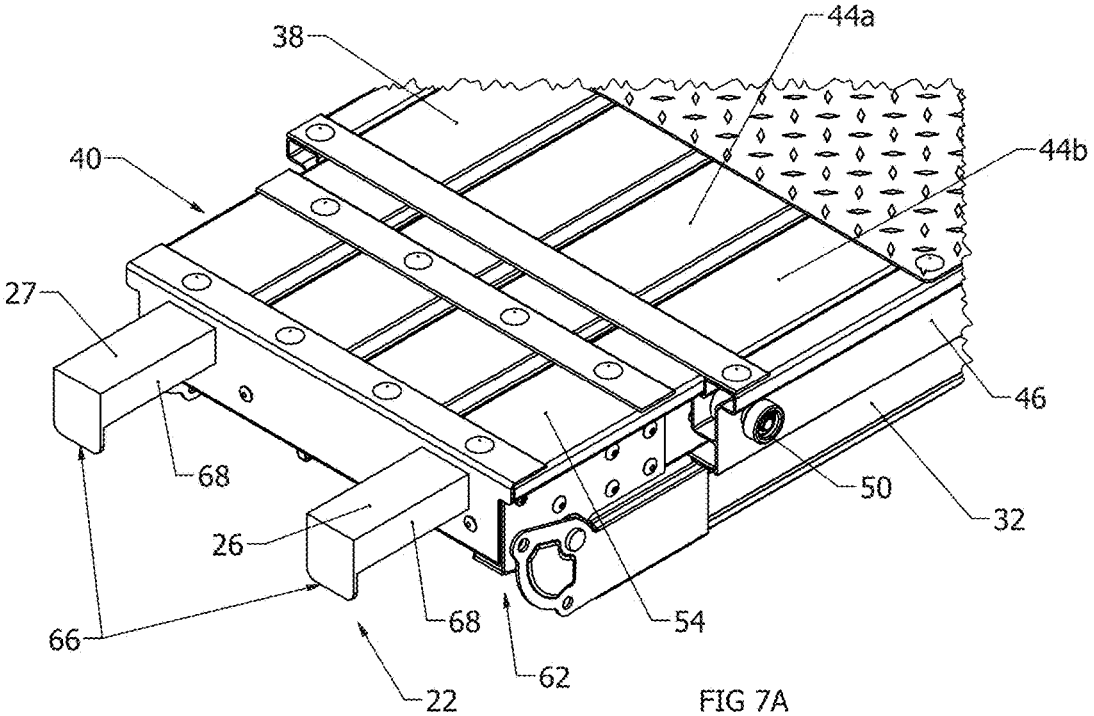
FIG. 7A is a sectional view of A of FIG. 7.

FIGS. 6, 6A, 7 and 7 A show an additional feature of this invention. Hooks 26, 27 are mounted in the work platform 10 at both ends which can be moved to a stowed position, as shown in FIGS. 6 and 6A, or a deployed position, as shown in FIGS. 7 and 7 A. Notice that the hooks 26, 27 have overhanging ends 66, as shown in FIG. 7A. In this embodiment, there are four separate hooks, each independent from the other. There are two hooks which extend from the outer end 62 of the first portion 40 and two hooks which extend from the outer end 64 of the second portion 42. Each hook of the first portion 40 fits in and is able to slide back and forth in an external first support, and each hook of the second portion 42 fits in and is able to slide back and forth in an external second support. Each hook is formed of a stem 68 which fits into the respective external first or second support 54, 60, and an overhanging end 66, which is a flat rectangular plate attached to the stem 68 which extends below the bottom of the stem 68. In a stowed position, as shown in FIG. 6 and FIG. 6A, the stem 68 of each hook fits completely within the respective first or second support 54, 60, and the overhanging end 66 fits on the surface of the respective outer end of the first or second portions 40, 42. The overhanging end 66 acts as a stop, preventing the hook 26, 27 from going too far into the respective external first or second support 54, 60, catching on the outer end of the respective portion 40, 42. Extending up from the base 71 of the outer end 62, in the path of the hook 26, 27, is a screw against which the inner end 87 of the stem 68 contacts, which acts as a stop that prevents the stem 68 from coming out of the first or second portion 40, 42 when the hook is pulled out and deployed, as shown in FIGS. 7 and 7A. Extending through the base 71 of the outer end 62 are the levers 73 of the hinge release mechanism, as shown in FIG. 10, which withdraw locking bars from the hinges of the leg assemblies 14, 18, as is well known in the art.

Figure 8:
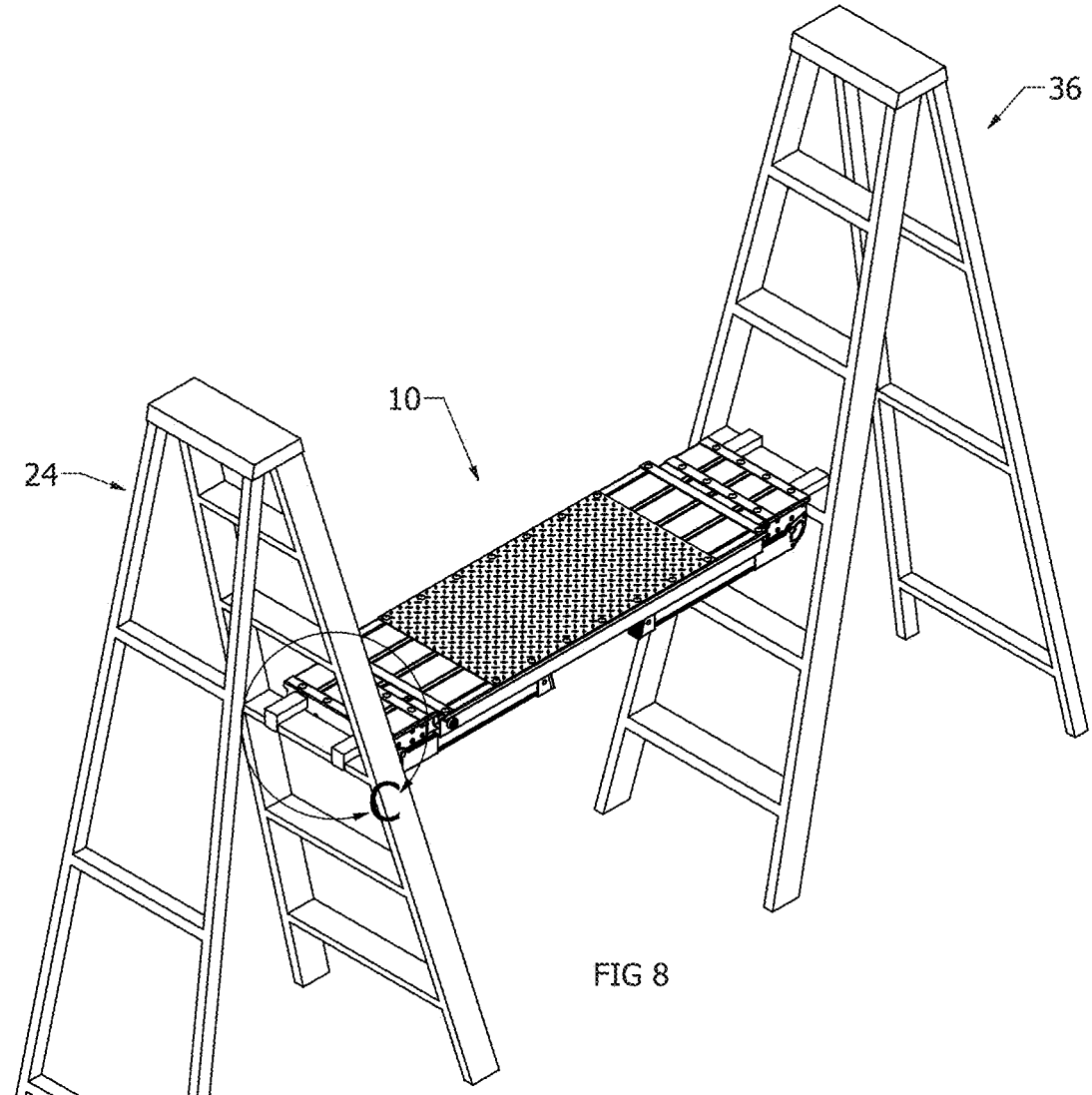
FIG. 8 shows how the hooks engage with the steps of stepladders when the work platform is in the retracted position.
Figure 8A:
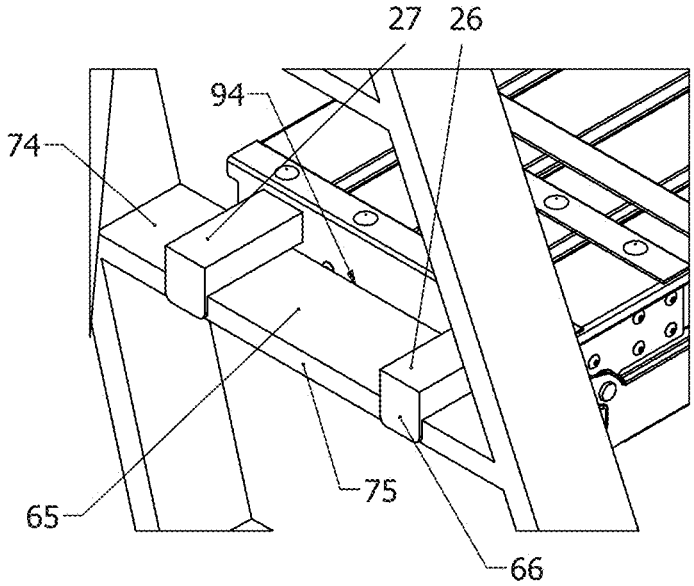
FIG. 8A is a sectional view of A of FIG. 8.
Figure 9:
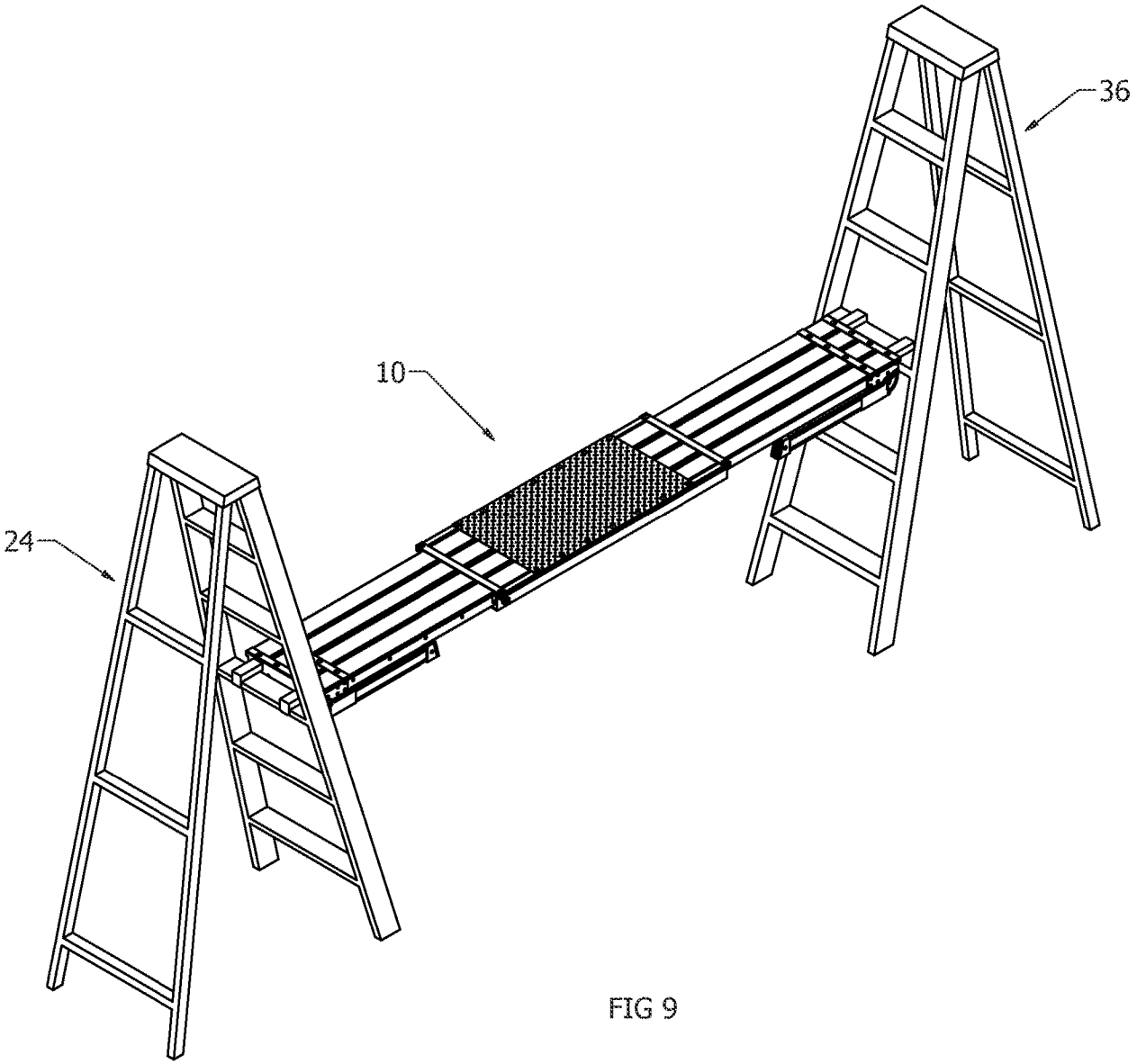
FIG. 9 shows how the hooks engage with the steps of stepladders when the work platform is in the extended position.

FIGS. 8 and 9 show how the hooks engage with the steps 65 of a first and second support structure 24, 36 such as stepladders. When used this way, the full length of the work platform 10 can be used by the user and the work platform 10 is securely held in place by the overhanging ends 66 of the hooks 26, 27. FIG. 8 shows the work platform 10 in the retracted position with the hooks 26, 27 deployed from the first portion 40 positioned on a step 65 at a desired height of a first support structure 24 and with the hooks 26, 27 deployed from the second portion 42 positioned on a step 65 at the same height of a second support structure 36. As shown in FIG. 8A, the stems 68 of the hooks 26, 27 rest flat on the top surface 74 of the steps 65 and the overhanging ends 66 extend down from the top surface 74 of the steps 65 and ideally contact the interior sides 75 of the steps 65. In this way, the work platform 10 stably and securely is positioned at a desired height with the support of the first and second support structures 24, 36 so users may climb on top of the work platform 10. In the same way, the work platform 10 in an extended position is supported by the first and second support structures 24, 36, as shown in FIG. 9. The hooks 26, 27 will also permit the work platform 10 to engage ladder jacks, roof jacks, scaffolds, etc.

FIGS. 10, 10A, 11 and 11A show a further embodiment in which springs 30 tend to cause the hooks 26, 27 to retract and a handle 28 with its own hooks connects the ends of the hooks. Both hooks on the same portion of the work platform 10 are attached to a handle 28 at their overhanging ends 66. The handle 28 is preferably one piece with a base 77 that is flat and is welded to the overhanging ends 66 and extends between the two hooks 26, 27 and preferably not beyond them. At the bottom of the handle base 77 and extending below the overhanging ends 66 in the first and second portions 40, 42 are arcs 79 which curve downwards and inwards from the base 77. At the top of the base 77, preferably extending along the length of the base 77 is a handle flange 81 which angles outwards and downwards, between 10° and 70° and preferably about 30° from the base 77.

The stems 68 of the hooks engage with and fit into the supports in the same way as they do in the embodiment described above where the hooks 26, 27 are separate and apart from each other. However, in this embodiment, the internal end 83 of each stem 68 is fixed to the outer end 85 of a handle spring, as shown in FIG. 10 and FIG. 11. The inner end 87 of the handle spring is fixed to a spring bracket 89 extending down from the inner surface of the respective support of the first or second portions 40, 42. In use, the user pulls the handle 28 outward, extending the hooks 26, 27 against spring force. In FIG. 12, the work platform 10 has been laid onto its support structures 24, 36, the handle 28 is released which allows the hooks 26, 27 to retract by the force of the springs 30 and the arcs 79 to positively engage the step 65 of the support structures 24, 36. The arcs 79 of the handle 28 fit under and contact the bottom surface 91 of the step 65, with the base 77 contacting the interior side 75 of the step 65 to securely and stably hold the work platform 10 in the desired position. The springs 30 act as stops preventing the hooks 26, 27 from being pulled out of the first supports 54, or second supports 60. FIG. 10 shows a bottom view of the first portion 40 with the handle 28 and hooks in a retracted position. FIG. 11 shows a bottom view of the first portion 40 with the handle 28 and hooks 26, 27 in an extended position. FIG. 10A is a bottom perspective view of the first portion 40 with the handle 28 and hooks 26, 27 in a retracted position. FIG. 11A is an overhead perspective view of the first portion 40 with the handle 28 and hooks 26, 27 in an extended position. FIG. 12 is a bottom perspective view of the first portion 40 with the handle 28 extended and engaged with the step 65.

FIGS. 13, 13A, 14 and 14A show yet another embodiment with recesses 33, 34 formed in the legs 32, 35 which are positioned to engage the work platform 10 support surfaces when the legs are in the closed position. FIG. 15 shows the work platform 10 supported by a support structure 24, 36 with the recesses 33, 34 engaged with the steps 65 of a support structure 24, 36.

In this embodiment, there are no hooks 26, 27 in the plank 12. Instead, recesses 33, 34 adjacent to the top of each leg 32, 35 serve to stabilize the plank 12 on the steps 65 of the support structure 24, 36. Each recess 33, 34 has a shape which conforms with the top surface 74 and interior 75 and exterior 94 sides of the step 65. Each recess 33, 34 has a long portion 90 which is straight and rests on the top surface 74 of the step 65. At each end of the long portion 90, a side portion 92 extends perpendicularly from the long portion 90. As shown in FIG. 15, the side portion 92 adjacent to the top of the leg fits over the interior side 75 of the step 65 and another side portion 92 fits over the exterior side 94 of the step 65 when the work platform 10 is placed on the steps 65 of a support structure 24, 36. The side portion 92 adjacent the top of the leg is able to couple to the interior side 75 of the step 65, preventing the plank 12 from being pulled away from the step 65, and the other side portion 92 is able to couple to the exterior side 94 of the step 65, which prevents the plank 12 from moving toward the interior of the ladder, thus preventing plank 12 from moving forward or back relative to the step 65.

Figure 13A:
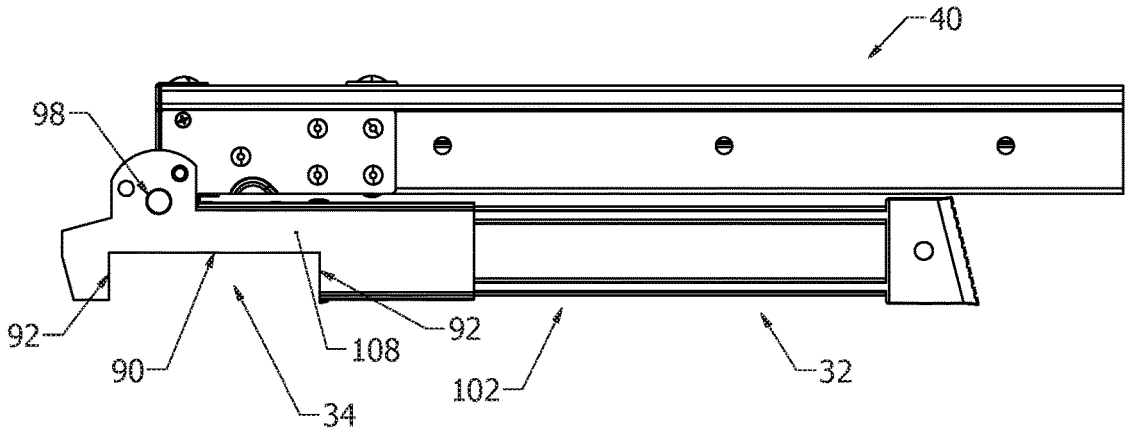
FIG. 13A is a side view of a leg with a recess in a closed position.
Figure 14A:
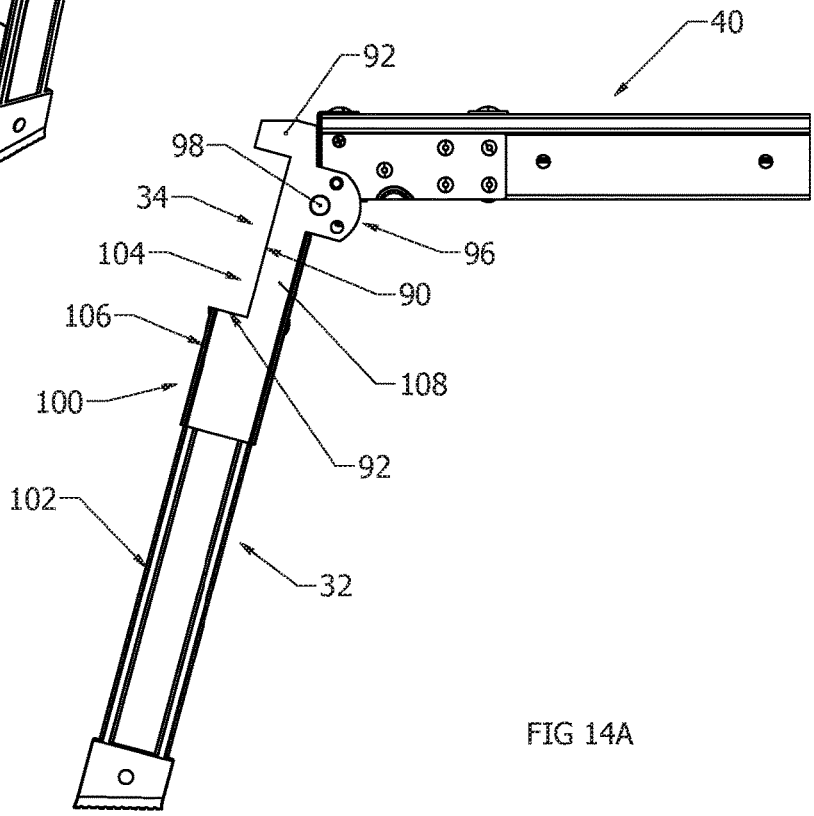
FIG. 14A is a side view of a leg with a recess in the open position.

A hinge portion 96 positioned opposite the recess 33, 34 adjacent the side portion 92 at the top of the leg, has a bolt 98 extending through it which rotatably attaches the leg 32, 35 to the plank 12 and serves as a pivot axis. The leg 32, 35 has an upper part 100 from about the top step 70 of the respective leg assembly 14, 18 and has a width about half the width of the lower part 102 of the leg so the leg does not block the step 65 from receiving the recess 33, 34. The recess 33, 34 with the hinge portion 96 is part of a leg plate 104 which has a lower portion 106 that extends down from the lower side portion 92 and which conforms with the outer circumference of the flange and webs of the lower part 102 of the leg 32, 35. The outer circumference of the flange and the webs of the leg plate 104 essentially form a C shape which matches the C shape of the outer circumference of the lower part 102 of the leg. The lower portion 106 is riveted to the lower part 102 of the leg adjacent where the top step 70 is attached to the leg. A central portion 108 of the leg plate 104 which extends upwards from the lower portion 106 in between the recess 33, 34 and the hinge portion 96, is riveted to the upper part 100 of the leg. FIG. 13 shows a perspective view of the legs 32, 35 with recesses 33, 34 in the closed position. FIG. 13A is a side view of a leg 32 with a recess 34 in a closed position. FIG. 14 shows a perspective view of the legs 32, 35 with recesses 33, 34 in an open position. FIG. 14A is a side view of a leg 32 with a recess 34 in the open position.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

The invention claimed is:

1. A work platform comprising:

a plank which telescopes to a desired width;

a first linkage disposed at a first end of the plank and adapted to engage a first support structure, the first linkage movable between an extended position extending out from the first end of the plank to engage the first support structure and a retracted position retracted within the first end of the plank;

a second linkage disposed at a second end of the plank and adapted to engage a second support structure, the second linkage movable between an extended position extending out from the second end of the plank to engage the second support structure and a retracted position retracted within the first end of the plank; and a first leg assembly rotatably attached adjacent to the first end of the plank and a second leg assembly rotatably attached adjacent to the second end of the plank, wherein the work platform is in an open position when the plank is supported by the first leg assembly and second leg assembly and wherein in the open position the first leg assembly and second leg assembly form an angle greater than 25 degrees with the plank, wherein the work platform is in a closed position when the first leg assembly and second leg assembly are adjacent to and in parallel with the plank, wherein the plank includes a deck, a first portion which extends and retracts from a first side of the deck, the first leg assembly being rotatably attached adjacent to an outer end of the first portion, and a second portion which extends and retracts from a second side of the deck, the second leg assembly being rotatably attached adjacent to an outer end of the second portion, and wherein the deck includes a lock to lock the first portion and the second portion at a desired position relative to the deck.

2. The work platform of claim 1 wherein the deck includes a plurality of hollow deck supports, which are in parallel and adjacent with each other and fixed together, the first portion includes a plurality of first supports which are attached together and fit into and slide in and out of the plurality of hollow deck supports, wherein the first supports are aligned with and fitted into the plurality of hollow deck supports at the first side of the deck.

3. A work platform comprising:

a plank which telescopes to a desired width;

a first linkage disposed at a first end of the plank and adapted to engage a first support structure, the first linkage movable between an extended position extending out from the first end of the plank to engage the first support structure and a retracted position retracted within the first end of the plank;

a second linkage disposed at a second end of the plank and adapted to engage a second support structure, the second linkage movable between an extended position extending out from the second end of the plank to engage the second support structure and a retracted position retracted within the first end of the plank; and a first leg assembly rotatably attached adjacent to the first end of the plank and a second leg assembly rotatably attached adjacent to the second end of the plank, wherein the work platform is in an open position when the plank is supported by the first leg assembly and second leg assembly and wherein in the open position the first leg assembly and second leg assembly form an angle greater than 25 degrees with the plank, wherein the work platform is in a closed position when the first leg assembly and second leg assembly are adjacent to and in parallel with the plank, wherein the plank includes a deck, a first portion which extends and retracts from a first side of the deck, the first leg assembly being rotatably attached adjacent to an outer end of the first portion, and a second portion which extends and retracts from a second side of the deck, the second leg assembly being rotatably attached adjacent to an outer end of the second portion, and wherein the first linkage includes a first hook adapted to hook onto the first support structure to secure the first linkage to the first support structure in the extended position.

4. The work platform of claim 3 wherein the first hook is mounted in the first portion of the plank and includes an overhanging end and a stem.

5. The work platform of claim 4, wherein the deck includes a plurality of hollow deck supports which are in parallel and adjacent with each other and fixed together, the first portion of the plank includes a plurality of first supports which are attached together and fit into and slide in and out of the plurality of hollow deck supports, wherein the stem of the first hook fits into one of the first supports.

6. The work platform of claim 3 wherein the first hook is part of a handle which extends from the first end of the plank, and engages a spring which biases the first linkage towards the retracted position.

7. The work platform of claim 6 wherein an inner end of the spring is fixed to a spring bracket extending down from an inner surface of the first portion of the plank, wherein when the handle is pulled outward and the first hook has been hooked onto the first support structure, releasing the handle allows the first hook to retract by force of the spring and securely engage the first support structure.

8. The work platform of claim 7 wherein the first support structure includes a step of a ladder.

9. A work platform comprising:

a plank which telescopes to a desired width;

a first linkage disposed at a first end of the plank and adapted to engage a first support structure, the first linkage movable between an extended position extending out from the first end of the plank to engage the first support structure and a retracted position retracted within the first end of the plank;

a second linkage disposed at a second end of the plank and adapted to engage a second support structure, the second linkage movable between an extended position extending out from the second end of the plank to engage the second support structure and a retracted position retracted within the first end of the plank; and a first leg assembly rotatably attached adjacent to the first end of the plank and a second leg assembly rotatably attached adjacent to the second end of the plank, wherein the work platform is in an open position when the plank is supported by the first leg assembly and second leg assembly and wherein in the open position the first leg assembly and second leg assembly form an angle greater than 25 degrees with the plank, wherein the work platform is in a closed position when the first leg assembly and second leg assembly are adjacent to and in parallel with the plank, wherein the first linkage includes a first stem movable between the extended position and the retracted position, the plank including a first slot that receives the first stem in the retracted position, and the first linkage including a second stem movable between the extended position and the retracted position, the plank including a second slot that receives the second stem in the retracted position, and the first linkage including a handle extending between the first stem and the second stem to facilitate movement of the first linkage between the extended position and the retracted position.

10. The work platform of claim 9, wherein the first linkage includes a first hook extending below the first stem and the handle and a second hook extending below the second stem and the handle.

* * * * *